United States Patent [19]

Pietzsch et al.

[11] 4,444,089

[45] Apr. 24, 1984

[54] STABILIZING AND AIMING DRIVE MEANS FOR A TURRET OF A VEHICLE

[75] Inventors: Ludwig Pietzsch; Bernhard Stehlin, both of Karlsruhe, Fed. Rep. of Germany

[73] Assignee: Dr.-Ing. Ludwig Pietzsch, Karlsruhe, Fed. Rep. of Germany

[21] Appl. No.: 352,869

[22] Filed: Feb. 26, 1982

[30] Foreign Application Priority Data

Mar. 5, 1981 [DE] Fed. Rep. of Germany ..... 3108368

[51] Int. Cl.[3] ..... F41G 5/24; F41F 21/14; F41H 7/08

[52] U.S. Cl. ..... 89/36 K; 89/41 M

[58] Field of Search ..... 89/41 R, 36 H, 36 K, 89/41 ME, 41 T, 41 H, 41 M, 41 LE

[56] References Cited

U.S. PATENT DOCUMENTS

| | | | |
|---|---|---|---|
| 2,436,582 | 2/1948 | Lear | 89/41 M X |
| 2,948,193 | 8/1960 | Leathers | 89/41 H |
| 3,429,222 | 2/1969 | Whiston et al. | 89/41 M |
| 4,326,447 | 4/1982 | Kauer | 89/41 H |

FOREIGN PATENT DOCUMENTS

| | | |
|---|---|---|
| 1286857 | 1/1969 | Fed. Rep. of Germany . |
| 2240569 | 1/1974 | Fed. Rep. of Germany . |
| 1241877 | 8/1960 | France . |
| 2221981 | 10/1974 | France . |

*Primary Examiner*—Donald G. Kelly

*Attorney, Agent, or Firm*—L. Lawton Rogers, III

[57] ABSTRACT

A stabilizing and aiming drive for the turret (2) of a vehicle (1) comprises brake surfaces at revolving rings (6,7) which are supported for rotation at the vehicle superstructure or at the turret. The revolving rings (6,7) are driven in opposite directions by an electric motor (20) acting through driven pinions (23,24), and they carry brake surfaces (10,11). These brake surfaces face the friction linings (12,13) which are adapted to be acted upon by magnetic structural units (16,17) provided at the turret or vehicle superstructure for engagement with the brake surfaces, in order to thereby apply controlled stabilizing and aiming moments on the turret.

13 Claims, 3 Drawing Figures

FIG. 1
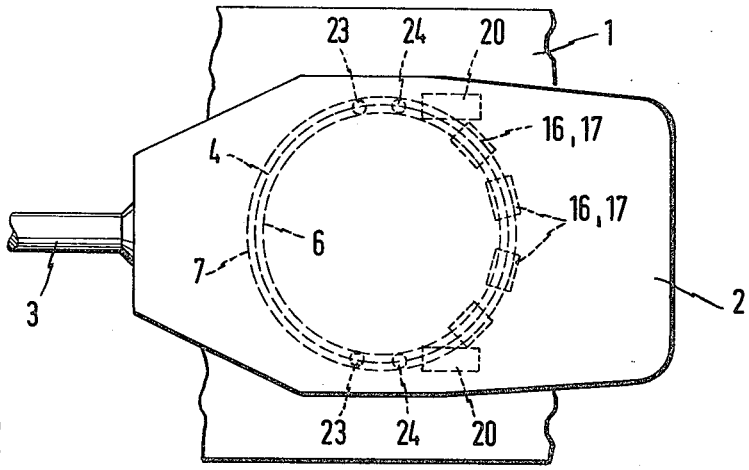
FIG. 2
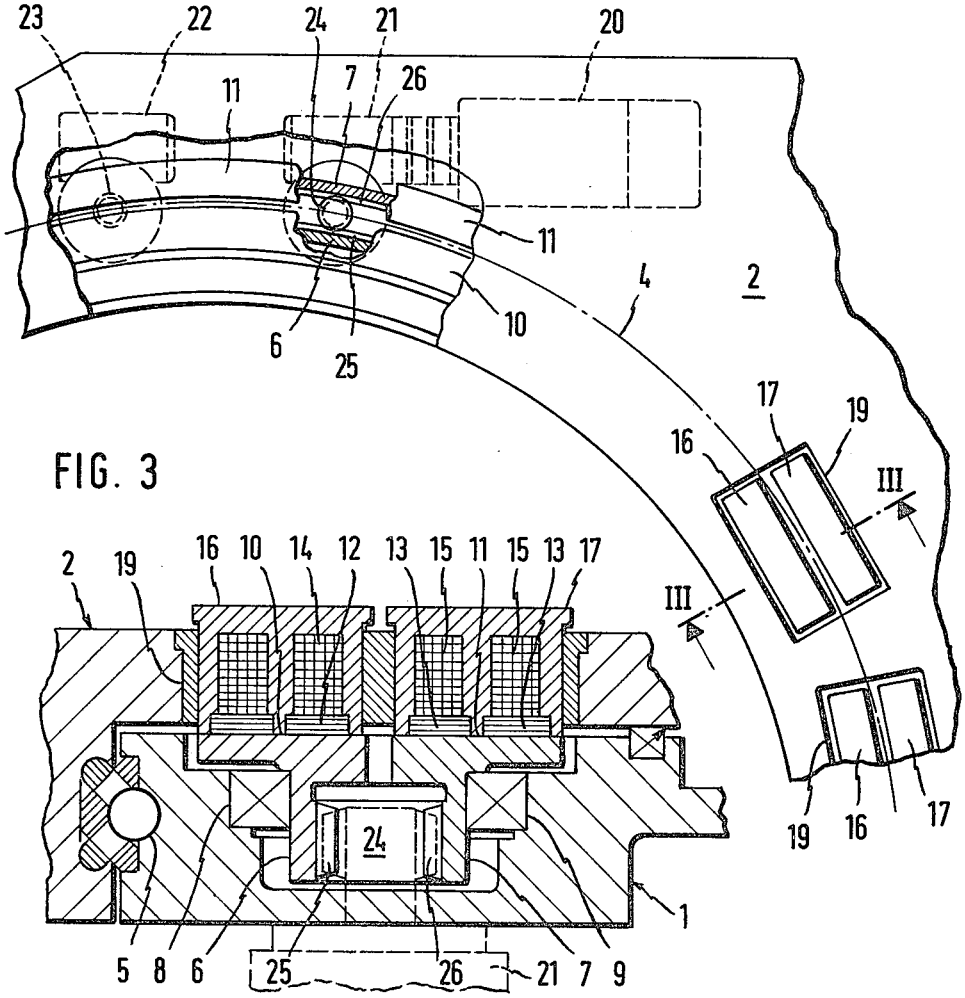
FIG. 3

STABILIZING AND AIMING DRIVE MEANS FOR A TURRET OF A VEHICLE

The instant invention relates to a stabilizing and aiming drive means for a turret of a vehicle, which turret is rotatably mounted by a rotation track on the vehicle superstructure and adapted to receive adjusting moments for its alignment in a desired direction applied by brake surfaces which are driven in opposite directions and by friction linings which are movable under pressure in controlled fashion against the brake surfaces.

A turret constitutes a component part, for instance, of a turret weapon system on an armored vehicle.

The torque to be applied by the stabilizing and aiming drive means of such a turret weapon system depends on the required moment of acceleration to overcome the intertia of the turret and on the maximum moments of imbalance occurring. Moments of imbalance must be accommodated in the azimuth of the stabilizing and aiming drive means, for example when the vehicle equipped with the turret finds itself in an inclined position, either at standstill or while driving, or when the center of gravity of the turret does not coincide with the axis of rotation and is accelerated linearly as the vehicle drives through curves or because of pitching and rolling movements.

Stabilizing and aiming or positioning drive means of the kind specified were already proposed in U.S. Pat. No. 4,326,447, dated Apr. 27, 1982, and U.S. Pat. No. 4,353,446, dated Oct. 12, 1982. They provide for a drive means which is positioned within a rotation track to transmit a driving moment from a pinion to the rotation track or live ring of the turret. This manner of introducing force has two essential disadvantages: The tooth strength limits the magnitude of the moment which can be transmitted. The introduction of the moment through the rotation track is dynamically "soft", and for this reason the quality of the control of the drive means realized by a control means which acts to direct the turret in a desired direction is reduced. Although normally the torques of the turret occurring because of the imbalance lie within the limits which the known drive means are adapted to apply, sometimes under extreme driving conditions the maximum aiming moments applicable by the known drive means are surpassed by the imbalance or disturbing moments mentioned. And as a consequence, the turret is turned undesirably with respect to the body. In comparison with other disturbing factors, such as friction the moments of imbalance mentioned are predominant.

It is an object of the present invention to provide a stabilizing and aiming drive means which is adapted to accommodate also great moments of imbalance which are typical for the turrets in question. It is a further object of the invention to improve the control quality.

To meet these objects it is provided, in accordance with the invention, that in a stabilizing and aiming drive means of the type specified initially, the brake surfaces are formed at two concentric revolving rings disposed adjacent the mean rotation track radius and supported on the vehicle superstructure or turret so as to be driven in opposite directions, and that the friction linings are arranged for axial movement on the turret or vehicle superstructure and disposed on the same mean radius as the revolving rings and adjacent the same.

The frictional force at the revolving rings produced by the stabilizing and aiming drive means according to the invention causes direct application of a stabilizing or aiming moment which counteracts the moments of imbalance. This moment is determined by the frictional force multiplied by the great lever arm between the revolving rings and the center of the turret. The inherent dynamic characteristics of the rotation track bearing and the otherwise usual gear are eliminated.

The contact pressure is applied with the aid of a control means which adjusts the turret in a predetermined desired direction (aiming) or maintains the turret in this direction, regardless of any movements of its support (stabilizing). The structure and mode of operation of this control means have been described in the above mentioned U.S. patents which are incorporated by reference.

Control circuits comprising disturbance feedforward, as used in general with controlled systems subject to important disturbing influences, may be employed with the present invention in order to improve the control quality. For instance, the linear acceleration acting at the center of gravity is measured and fed forward to the control circuit.

Like the known stabilizing and aiming drives also the drive means according to the invention operates with a great servo ratio. In other words, the power needed to control the contact pressure is much less than the power which is required for aiming the turret.

The uncontrolled primary power, preferably, is made available by at least one drive group which, preferably, is arranged at the vehicle superstructure and, for example, includes an electric motor.

It is preferred to press the friction linings electromagnetically against the brake surfaces of the revolving rings, the electric power to be supplied to the turret through a slip ring being much less than the primary power.

Proper selection of the effective magnetic surface of the electric magnets permits a design of the stabilizing and aiming drive means for very high maximum moments.

The magnetic force needed to press the friction linings into contact with the brake surfaces may also be applied by permanent magnets counteracting the electric magnets. In case of power failure the permanent magnets cause blocking of the brake surfaces, in other words locking or "tieing" of the turret with respect to the vehicle superstructure in a very simple manner.

An additional toothing may be provided at one of the revolving rings for cooperation with a manually operated pinion in case emergency operation is needed.

The invention will be described further, by way of example, with reference to the accompanying drawings, in which:

FIG. 1 is a top elevational view, partly broken away, of an armored vehicle including a turret;

FIG. 2 is a sectional view of the turret according to FIG. 1, on an enlarged scale and with parts broken away;

FIG. 3 is a part sectional view along line III—III in FIG. 2, on a further enlarged scale.

In FIG. 1 reference numeral 1 designates a vehicle superstructure, 2 a turret including a gun 3 and a rotation track or live ring 4 by means of which the turret 2 is rotatable in relation to the vehicle superstructure 1.

As may be seen in FIGS. 2 and 3 the rotation track comprises a pivot bearing which is generally designated 5 and which supports the turret 2 on the vehicle superstructure 1. Furthermore, two revolving rings 6,7 are rotatably supported on the vehicle superstructure 1 by bearings 8,9, somewhat radially outside of the pivot bearing 5. The revolving rings 6,7 are provided at their tops with brake surfaces 10,11 for cooperation with several pairs each of friction linings 12,13. Each pair of friction linings is associated with pairs of electric magnets 14,15, and together they are received in housings 16,17. Together with the friction linings the housings constitute a structural unit each, received for axial floating and radially without clearance in a sliding guide 19 of the turret 2. In correspondence with the desired performance, a plurality of such housings 16,17 joined in pairs (cf. FIG. 2) may be disposed offset in circumferential direction on the central radius of the rotation track 4.

In FIG. 2 an electric motor 20 acting on two gear transmissions 21,22 is shown in phantom. Each gear transmission comprises a driven pinion 23,24. Although displaced in circumferential direction with respect to the line of the cut III—III, also pinion 24 is indicated in FIG. 3 in discontinuous lines. It cooperates with an external toothing 25 at the revolving ring 6 and, at the same time, with an internal toothing at the revolving ring 7. Thus the revolving rings are driven in opposite directions, yet at the same number of revolutions by the two pinions 23,24. As two pinions are employed, the tooth forces are kept relatively small. A corresponding drive means 20, again including two driven pinions 23,24 may be provided at the diagonally opposed side, as indicated in FIG. 1.

Part of the housings 16,17 may contain permanent magnets (not shown) exerting permanent attractive force between the friction linings 12,13 and the brake surfaces 10,11. In operation the electric magnets are controlled to act against the permanent magnets. In inoperative condition the counteraction of the electric magnets 14,15 is cancelled. In this manner blocking by force lock or tieing is effected by the permanent magnetic force between the turret 2 and the vehicle superstructure 1.

The electric magnets 14,15 are excited by a control means (not shown) which applies actuating signals to the electric magnets 14 or to the electric magnets 15 in case the rotary position of the turret 2 or gun 3 deviates angularly from a predetermined desired direction, in order to cancel said angular deviation. In this way the corresponding revolving ring 6 or 7 is braked, whereby a drive moment is applied to the turret practically without delay, which moment varies in accordance with the magnitude of the control pulse. However, in view of the great spacing between the electric magnets 14,15 and the center 4 of the rotation track (FIG. 1) and because the surface area of the friction linings 12,13 may be chosen to have any desired size, the drive moment always may be made greater than the greatest imbalance moments of the turret occurring in practice.

We claim:

1. In a stabilizing and aiming drive means for the turret of a vehicle, which turret is mounted on a track on the vehicle superstructure for rotation in response to alignment adjusting moments applied by the selective movement of friction linings against oppositely driven brake surfaces, the improvement:

wherein said brake surfaces include two concenteric revolving rings disposed adjacent the mean radius of the rotation track, said surfaces being supported on one of (i) said vehicle superstructure and (ii) said turret for driving rotation in opposite directions, and wherein said friction linings (12, 13) are supported for movement parallel to the axis of turret rotation on said one of (i) said vehicle superstructure and (ii) said turret and are disposed on the same mean radius as that of said revolving rings in proximity to said revolving rings.

2. The drive means as claimed in claim 1, wherein each of said revolving rings is provided with peripheral teeth facing the other of said revolving rings, said teeth cooperating with at least one common driven pinion positioned between them.

3. The drive means as claimed in claim 2, wherein said revolving rings cooperate with at least two common driven pinions between them.

4. The drive means as claimed in claim 3, wherein said driven pinions are circumferentially offset with respect to each other.

5. The drive means as claimed in claim 1 including magnetic force means for pressing said friction linings against said brake surfaces.

6. The drive means as claimed in claim 5, wherein said friction linings are combined with controllable electric magnets in structural units which are arranged so as to be floating in a direction parallel to the axis of rotation of said turret and at a common radius therefrom.

7. The drive means as claimed in claim 6 wherein said magnetic force means includes permanent magnets selectively opposed by said electric magnets.

8. The drive means as claimed in claim 1 including a manually operated pinion and an additional toothing provided at one of said revolving rings (6, 7) to cooperate with said manually operated pinion.

9. The drive means as claimed in claim 1 including means for measuring linear acceleration at the center of gravity of the turret (2) and a control circuit for control of the contact pressure of the friction linings (12, 13) so as to improve the control quality in response to said measuring means.

10. A stabilizing and aiming drive for the rotatable turret of a vehicle comprising:

a vehicle;

a turret;

circular track means for securing said turret to said vehicle for relative rotation; and drive means carried by at least one of said vehicle and said turret, said means including:

first and second concentric rings, means for driving said rings in opposite directions, and means for selectively coupling said turret to a selected one of said rings whereby said turret may be selectively rotated with respect to said vehicle when coupled to one of said driven rings.

11. The drive of claim 10 wherein the radius of said two rings is substantially the same as the radius of said circular track means.

12. The drive of claim 11 wherein said coupling means includes magnetically controlled friction pads.

13. The drive of claim 10 wherein said coupling means includes magnetically controlled friction pads.

* * * * *